United States Patent [19]

Evans

[11] 4,126,194

[45] Nov. 21, 1978

[54] ROCK BIT WITH EXTENDED PICKUP TUBE

[75] Inventor: Robert F. Evans, La Habra, Calif.

[73] Assignee: Smith International, Inc., Newport Beach, Calif.

[21] Appl. No.: 814,352

[22] Filed: Jul. 11, 1977

[51] Int. Cl.[2] ..... E21B 9/08

[52] U.S. Cl. ..... 175/340; 175/67; 175/393

[58] Field of Search ..... 175/65, 67, 215, 324, 175/339, 340, 393, 422, 417, 418, 419

[56] References Cited

U.S. PATENT DOCUMENTS

| | | | |
|---|---|---|---|
| 1,729,063 | 9/1929 | Bull | 175/340 |
| 1,945,258 | 1/1934 | Collins | 175/340 |
| 2,692,117 | 10/1954 | Kucera et al. | 175/340 |
| 2,776,115 | 1/1957 | Williams, Jr. | 175/339 |
| 2,885,185 | 5/1959 | Sartor | 175/340 |
| 3,070,182 | 12/1962 | Runte | 175/339 |
| 3,099,324 | 7/1963 | Kucera et al. | 175/339 |
| 3,363,706 | 1/1968 | Feenstra | 175/340 |
| 3,384,191 | 5/1968 | Schumacher, Jr. et al. | 175/340 |
| 3,542,144 | 11/1970 | White | 175/339 |
| 3,923,109 | 12/1975 | Williams, Jr. | 175/340 |
| 4,022,285 | 5/1977 | Frank | 175/65 |

FOREIGN PATENT DOCUMENTS

| | | | |
|---|---|---|---|
| 2,529,380 | 1/1976 | Fed. Rep. of Germany | 175/340 |

*Primary Examiner*—Ernest R. Purser
*Assistant Examiner*—Richard E. Favreau
*Attorney, Agent, or Firm*—Knobbe, Martens, Olson, Hubbard & Bear

[57] ABSTRACT

A three cone rock bit includes an improved circulation system for drilling fluid which increases the horizontal flow vector of the fluid adjacent the bottom surface of the hole being drilled. A pair of nozzles, located near the hole perimeter and between adjacent pairs of drilling cones, inject drilling fluid at one side of the hole. An extended pickup tube terminating between the remaining pair of drilling cones and close to the bottom of the hole being drilled channels fluid from the bottom of the hole to the annulus between the hole and the drill string.

33 Claims, 7 Drawing Figures

FIG. 5.
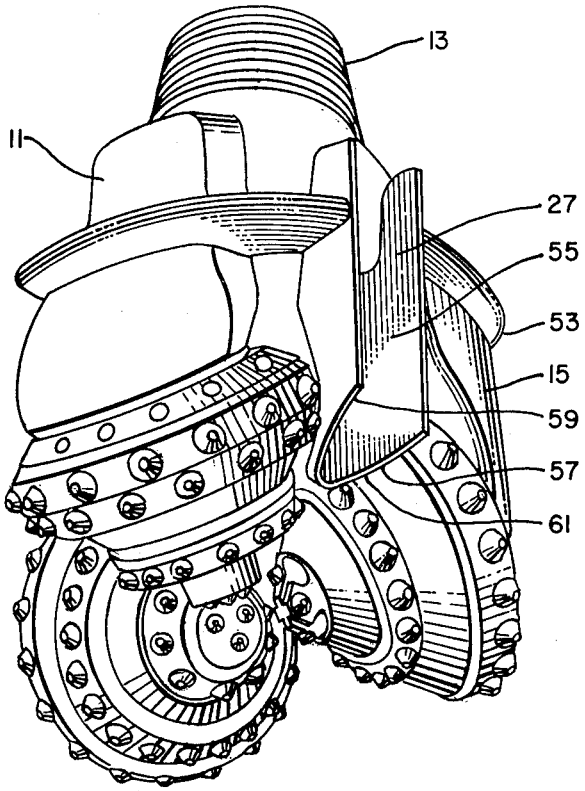
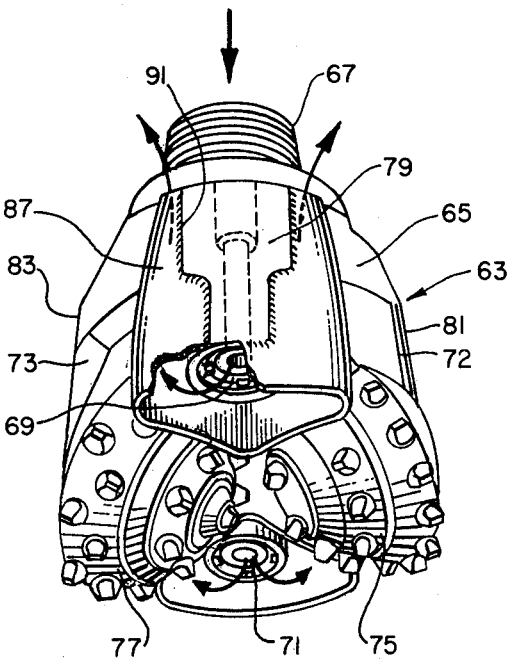
FIG. 6.
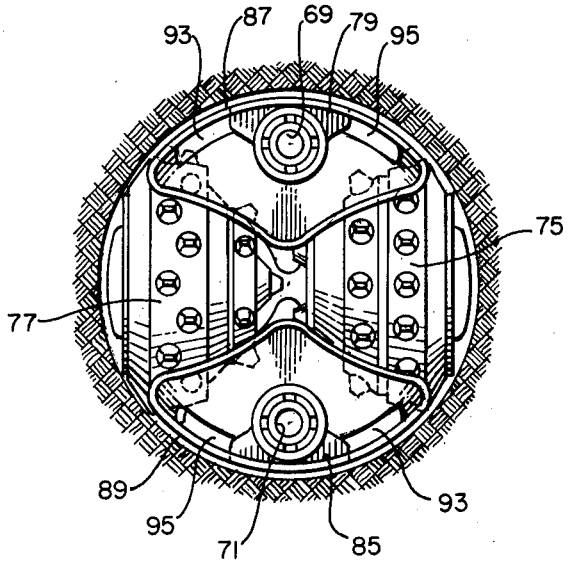
FIG. 7.

ROCK BIT WITH EXTENDED PICKUP TUBE

BACKGROUND OF THE INVENTION

This invention relates to hydraulic circulation systems for cleaning holes being drilled in rock and earth, as in the oil industry. More particularly, the present invention relates to a pickup tube mounted on a rock bit in a position which improves the removal of cuttings by increasing horizontal flow at the bottom of such a hole.

While substantial advances have been made in rock bit technology relating to virtually every element of such bits, one of the remaining limiting characteristics, particularly in bits having three or fewer cones, is the tendency of the cutting teeth to recut or regrind rock already cut away from the bottom of the hole. This tendency is due primarily to the inability of the drilling fluid circulation system to adequately sweep chips from the bottom of the hole before successive cones capture and recrush them.

To some extent, these problems have been reduced in large diameter rock drilling bits, such as those used for drilling mine shafts. Such bits, although plagued with other problems because of their size, nevertheless permit the strategic placement of nozzles and extended collection tubes for efficient chip removal from the hole bottom. Small gage holes do not permit such freedom of location of flow controlling members. Nevertheless, the extensive use of rock bits having three or fewer cones in relatively small gage holes in the oil industry has led to numerous attempts to improve the chip removal system in such bits. None of these attempts have been entirely satisfactory.

One of the limiting requirements is the construction of a three cone bit itself, since virtually all of the space at the bottom of the hole is occupied by drill bit cutting faces. A further limitation is the high pressures and flow rates of the drilling fluid itself, which prohibits flow conduits which would induce radical direction changes in the fluid. Thus, prior systems which attempted to change the course of the drilling fluid at the bottom of the hole to induce an upward flow direction from upturned nozzles have been found to be impractical, since fluid, particularly when abrasive, will literally destroy nozzles which attempt to turn the 90+ degrees required for upward flow.

Virtually all systems for altering the hydraulic drill fluid flow characteristics have concentrated on the nozzles which direct a powerful stream of drilling fluid toward the hole bottom. Once removed by this stream, the cut chips are permitted to escape (generally around the annulus between the bit and the walls of the drilled hole), without particular concern regarding the outgoing flow pattern. In many instances this outgoing flow places a large percentage of the chips in a location which is likely to cause regrinding of the chips by the gage surfaces of the cones, limiting the life of the gage surfaces.

Some prior art has attempted to place all input nozzles on one side of the hole, and to increase flow clearances on the other side of the hole. These systems, however, because of the tendency of the drilling fluid to flow upward after impact with the hole bottom, have met with only limited success.

Thus, the prior art, in concentrating on improving the nozzle portion of the drilling fluid circulation system, has been faced with the continuing requirement that radical flow direction changes not be included in the pressure fluid passages, so that only a limited degree of horizontal flow could be induced at the bottom of the drilled hole. This requirement, together with the severe space limitations in three cone bits, has thus far prevented the prior art from generating large horizontal flow vectors.

SUMMARY OF THE INVENTION

The present invention solves many of the problems associated with fluid circulation in prior three cone bits by approaching the problem from the other direction, that is, from the fluid pickup end. The invention basically entails a removal of one of the three standard fluid injection nozzles in a three cone rock bit and its replacement by a drilling fluid transfer tube which extends between the annulus surrounding the drill string and a location between a pair of adjacent cones near the bottom of the hole being drilled.

By placing the end of this pickup tube close to the hole bottom, and by passing 10 to 50 percent of the total drilling fluid flow through this transfer tube, it is possible to produce a very substantial horizontal flow vector along the bottom of the drilled hole to rapidly remove cut chips and thus limit the degree of recutting. This is accomplished without radical direction changes in the input fluid nozzle conduits.

The drilling fluid is still injected into the hole in high pressure streams from a pair of injection nozzles, and the full force of these fluid streams impinges, nearly vertically, against the hole bottom to provide a powerful loosening action for lifting and removing the cut chips. Once the primary flow energy is spent impinging upon the hole bottom, much of the flow proceeds toward the extended pickup tube of the present invention, flowing horizontally adjacent the hole bottom. This flow path reduces the amount of cut chips brought into contact with the cutting teeth of any of the cones. A portion of the drilling fluid will still pass through the annulus between the bit and the walls of the drilled hole. At least 10 percent of the fluid, however, generates a powerful horizontal washing stream along the hole bottom between adjacent cones for a greatly improved chip removal system.

These and other advantages of the present invention are best understood through the following detailed description which references the drawings in which:

FIG. 5 is a perspective view, similar to FIG. 1, showing an alternate embodiment of the present invention;

FIG. 6 is a perspective view, showing the bottom of a two cone rock bit having an alternate embodiment extended fluid pickup tube of the present invention; and FIG. 7 is a bottom plan view of the rock bit of FIG. 6 showing the arrangement of inlet nozzles and the extended pickup tube of the present invention.

DETAILED DESCRIPTION OF THE PREFERRED EMBODIMENT

Figure 1:
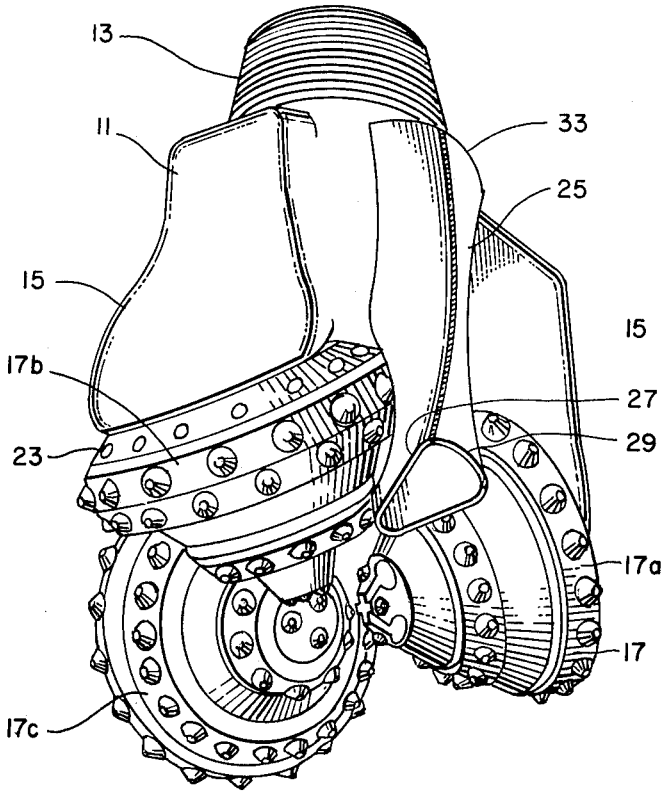
FIG. 1 is a perspective view showing the bottom of a three cone rock bit with the extended fluid pickup tube of the present invention installed.
Figure 2:
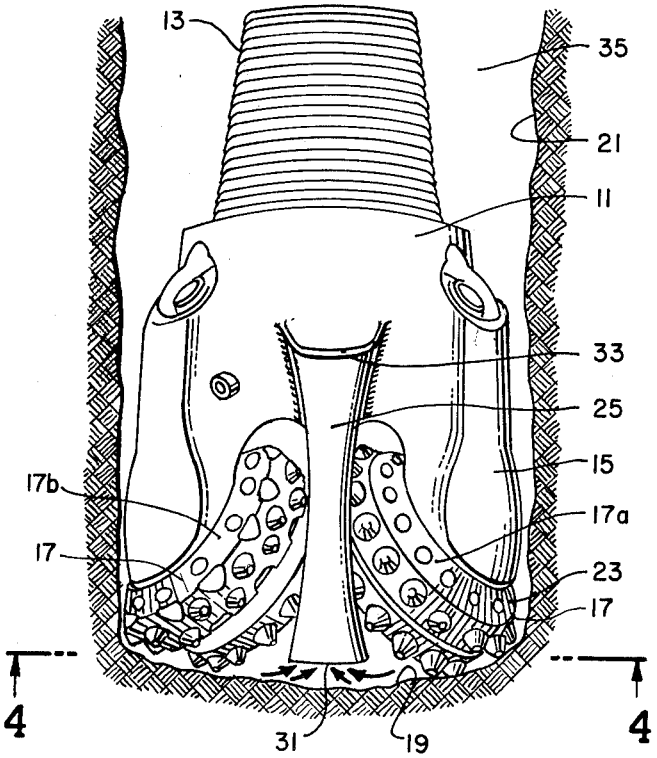
FIG. 2 is an elevation view showing the rock bit of FIG. 1 positioned within a hole being drilled, the hole being shown in section, further illustrating the extended pickup tube of the present invention.

Referring initially to FIGS. 1 and 2, the rock bit of the present invention includes a main body 11 which includes an externally threaded, upward extension 13 used for attaching the body 11 to a drill string (not shown). The main body 11 and the extension 13 each include a hollow central passageway for conducting drilling fluid from the central bore of the drill string (to which the extension 13 is attached) to plural nozzles which will be explained in detail below.

The body 11 additionally includes three outwardly angled, downwardly extending mounting flanges or legs 15 integral with the body 11. These legs 15 in turn each mount a cone shaped cutter 17. It will be understood by those skilled in the art that the cones 17, in common fashion, are mounted on roller shafts (not shown) extending inwardly from the legs 15. It will also be understood that the roller shafts mount the cones 17 on a plurality of ball bearings and roller bearings in a conventional manner so that the cones 17 are mounted on the body 11 in an orientation which provides that the central axes of the cones 17 will not meet at a common point. As the body 11 is rotated by the drill string (not shown), the cutters 17 will roll along the bottom of the hole being cut, while at the same time abrading the hole bottom due to the sliding action induced as a consequence of mounting the cones 17 without a common central rolling axis. All of this, it will be understood, is common practice in the three cone rock bit art and does not, by itself, except in combination with elements yet to be described, constitute the present invention. The three cones 17 are oriented at 120 degrees circumferentially spaced locations, each substantially covering a 120 degree circular segment at the bit bottom, and each extending to grind the entire radius of a drilled hole.

Referring now to FIG. 2, it will be seen that the rock bit of FIG. 1 is utilized to drill holes in rock and earth formations, with the lower side of the cones 17 lying nearly flat on the bottom 19 of the hole 21 being drilled. The diameter of the hole 21 is determined by gage surfaces 23 on each of the cones 17. These gage surfaces 23 extend slightly beyond the outer perimeter of the legs 15 and thus assure clearance for rotation of the main body 11 within the drilled hole 21.

Referring to both FIGS. 1 and 2, it will be seen that an extended pickup tube 25, according to the present invention, is mounted on the main body 11 intermediate a pair of the cutting cones **17*a* and 17*b*. The tube 25 is generally triangular in cross-section and fitted into a V-shaped slot in the side of the main body 11 intermediate a pair of legs 15. The tube 25 may be formed by first welding a V-shaped portion 27 to the body 11 and later covering this portion 27 with a relatively flat cover portion 29 welded to portion 27**.

As best shown in FIG. 2, the tube 25 extends at one end 31 to a location adjacent the bottom 19 of the hole 21. It has been found that the lower end 31 of the tube 25 should be separated from the bottom 19 of the hole 21 by a distance which is no greater than one quarter the diameter of the hole 21, and preferably less than one eighth this diameter. The other end 33 of the tube 25 extends to a location on the main body 11 above the legs 15 for direct communication with the annulus 35 between the hole 21 and the drill string (not shown) connected to the extension 13 of the body 11. Thus, direct fluid communication between areas adjacent the bottom 19 of the hole 21 and the annulus 35 is provided by the tube 25. The interior, open, cross-sectional area of the tube 25 should be kept as large as is physically possible without interfering with operation of the cone cutters 17. This generally results in a cross-section for the tube 25, as shown in FIG. 2, in which the bottom 31 is slightly belled, while the central portion is narrowed to fit between the adjacent cones **17*a* and 17*b*. In most cases the entire length of the tube 25** will have a substantially triangular cross-sectional area.

Figure 3:
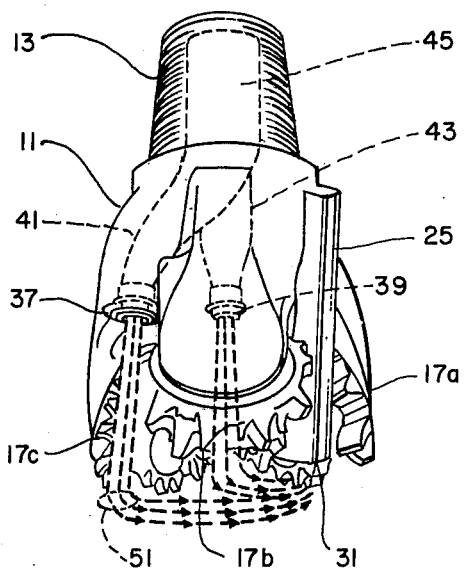
FIG. 3 is a perspective view of the rock bit of the present invention showing the fluid channels in phantom lines.

Referring now to FIG. 3, the effect of the extended pickup tube 25 in the hydraulic flow system of the present invention will be described. It will be appreciated by those skilled in the art that common practice with regard to three cone rock bits has been to mount a drilling fluid injection nozzle between each pair of adjacent cones. These nozzles direct a powerful stream of drilling fluid at the bottom 19 of the hole being drilled 21. In the present bit 11, however, only two such nozzles 37 and 39 are used. Each of these nozzles 37, 39 is centered between adjacent pairs **17*a*, 17*c*, and 17*c*, 17*b* of cutting cones near the outer circumference of the body 11. These nozzles 37, 39 communicate through manifolds 41, 43, respectively, with a central passage 45 formed in the body 11 and extension 13, and through this passage 45 with the center of the drill string supporting the bit 11. It will be understood by those skilled in the art that drilling fluid is pumped at high pressures and high flow rates into the passage 45 and is pumped through the nozzles 37, 39 to produce an extremely powerful flushing action on the bottom 19 of the hole 21. Fluid entering the hole 21 is permitted to flow back to the surface of the ground through the annulus 35 between the drill string and the hole 21. Such fluid reaches the annulus 35 either by passing between the outer perimeter of the legs 15 and the inside diameter of the hole 21, or directly through the extended pickup tube 25 of the present invention. The dimensions of the bit and the tube 25 are maintained so that a minimum of 10 percent of the drilling fluid entering through the nozzles 37, 39 exits through the tube 25. Preferably at least 25 percent, and advantageously as much as 35 percent, of the fluid may exit through the tube 25**.

It should be noted that the flow shown schematically by arrows 47 in FIG. 3 between the jet produced by nozzle 37 and the bottom 31 of the pickup tube 25 moves substantially horizontally along the bottom 19 of the hole being drilled 21. This horizontal flow of drilling fluid is an important aspect of the present invention. It will be appreciated that the remaining portions of the drilling fluid which pass between the legs 15 and inside diameter of the hole 21 move generally vertically away from the point of impact of the stream from the nozzle 37 with the bottom 19 of the hole 21. This vertical movement can carry chips away, but it cannot further loosen chips on the bottom 19 of the hole. Thus, ordinarily only the main force of the stream from the nozzles 37, 39 can be used for dislodging chips and debris from the bottom 19. With the present invention, however, the strong horizontal flow between the point of impact of the jet streams on the bottom 19 and the extended bottom end 31 of the tube 25 greatly increases the effectiveness of the drilling fluid in removing debris and thus reducing the amount of recutting of debris by the cones 17. Elimination of recutting, of course, extends the life of the cones 17 and thus increases the efficiency of the entire drilling operation.

Figure 4:
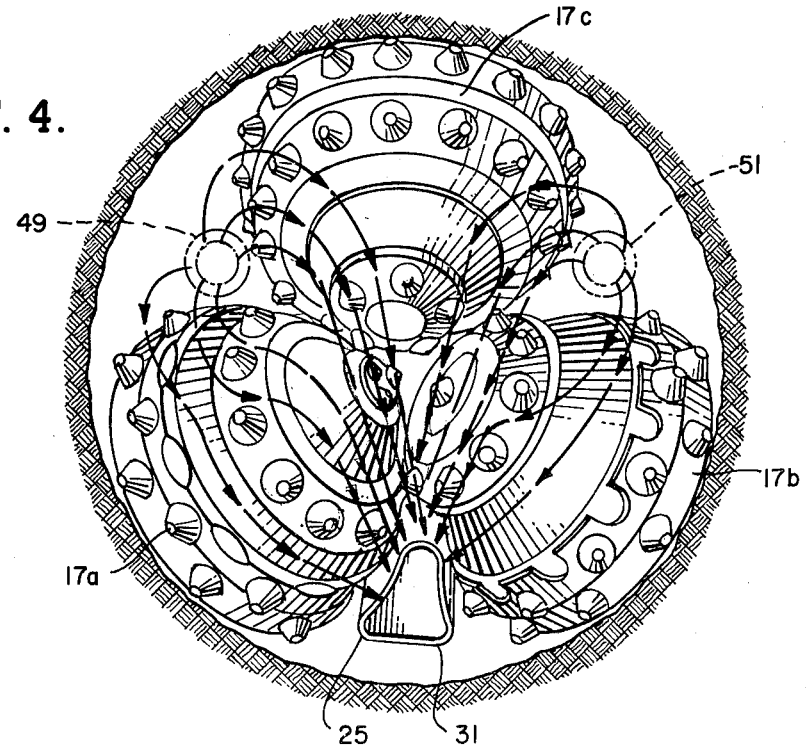
FIG. 4 is a bottom plan view of the rock bit of the present invention showing schematically the horizontal flow pattern on the bottom of the hole produced by the extended pickup tube of the present invention.

Referring now to FIG. 4, the flow pattern between the point of impingement 49 of the stream from nozzle 39 and the point of impingement 51 of the stream from nozzle 37 on the bottom 19 of the hole and the end 31 of the tube 25 will be described. It will be seen from the schematic illustration of FIG. 4 that at the points of impingement 49, 51 the flow tends to radiate horizontally outwardly from the impact point. Beyond these immediate impact points, a substantial portion of the flow will curve and move directly toward the open end 31 of the tube 25. This produces a cleaning flow along the axis of the cutting cone 17*c* and laterally across the axes of the cutting cones 17*a* and 17*b*, in a horizontal flow pattern, which tends to remove debris before a second cutter can regrind previously removed chips. The flow pattern between the points of impingement 49, 51 and the end 31 of the tube 25 is primarily along the intersection of the cutters 17*a, b, c*. Since this is the course which provides the least flow resistance. A strong cleaning stream is thus provided at the intersection of the cones 17*a* through 17*c* so that particles cut by each cone will be swept from the intersection before the next successive cone rolls over the same location on the bottom 19 of the hole 21.

Referring now to FIG. 5, an alternative embodiment of the present invention, which incorporates three separate altered features, will be described. In this instance, the main body 11 and extension 13 of the bit are virtually identical to that shown in FIG. 1, except that the main body 11 at a location adjacent the legs 15 includes an annular, outwardly extending rib 53 designed to be slightly smaller than the inside diameter 21 of the hole being cut. This rib 53 reduces the flow of drilling fluid around the outer extremities of the body 11 and thus increases the proportion of fluid which will flow to the annulus 35 by way of the extended pickup tube of the present invention.

It can be seen that, in addition to this alteration, the embodiment of FIG. 5 includes the V-shaped portion 27 of the extended pickup tube, but not the cover portion 29 shown in FIG. 1, so that the pickup tube 55 of the embodiment of FIG. 5 utilizes the inside diameter 21 of the previously drilled hole as the third side of the triangular cross-sectional conduit. The V-shaped portion 27 thus provides a smooth flow path, and the bottom 57 of this member extends to a location close to the bottom 19 of the hole being drilled, so that the operation of this embodiment is substantially identical to that of FIG. 1.

The third alteration shown in the embodiment of FIG. 5 is the expedient of making the leading edge 59 of the bottom 57 of the V-shaped portion 27 of pickup tube 55 shorter than the trailing edge 61, so that the trailing edge 61 is closer to the bottom 19 of the hole than is the leading edge 59. This permits larger chips to pass under the leading edge 59 of the pickup tube 55 while still increasing the flow velocity near the trailing edge 57 by maintaining a close spacing between this edge 57 and the bottom 19 of the hole.

While the embodiments of this invention shown in FIGS. 1 through 5 includes inlet flow nozzles on one side and near the perimeter of the rock bit, it will be recognized by those skilled in the art that it has been common to manufacture rock bits with a central inlet water flow passage with or without a nozzle. The present invention, of course, may be adaptd to such central flow bits as well as the bit shown in FIGS. 1 through 5 and will provide increased horizontal flow at the bottom of the hole being drilled.

Referring now to FIGS. 6 and 7, a second alternate embodiment of the present invention, this one incorporated into a two cone rock bit 63, will be described. This bit is somewhat similar in construction to the three cone bit of FIGS. 1–5 and includes a main body 65 having an externally threaded upward extension 67 used for attaching the body 65 to a drill string (not shown). The main body 11 and extension 13 include a central passage for conducting drilling fluid from the central bore of the drill string (to which the extension 67 is attached) to a pair of nozzles 69 and 71. The nozzles 69 and 71 extend from diametrically opposed sides of the rock bit 63 toward the bottom of the hole being drilled and supply a powerful, vertically directed pair of drilling fluid jets toward the bottom of the hole for washing the hole bottom and lifting loosened chips therefrom.

At diametrically opposed locations displaced about the axis of the bit 63, 90° from the nozzles 69, 71, a pair of legs 72 and 73 extend away from the extension 67 and support a pair of cone shaped cutters 75 and 77 on roller shafts and bearings (not shown). As with the three cone bit of FIGS. 1 through 5, as the rock bit 63 is rotated by the drill string (not shown), the cutters 75, 77 roll along the bottom of the hole being cut while at the same time abrading the bottom of the hole.

At locations circumferentially spaced by 90 degrees from one another, surrounding the main body 65 of the rock bit 63, centering lands 79, 81, 83, and 85 are formed on the radially outermost surfaces of the nozzles 69, 71 and legs 72, 73 to assist in centering the bit in the hole during drilling operations. Two of these lands 79, 85 at the outer surfaces of the nozzles 69 and 71, respectively, provide a mounting support for a pair of extended fluid pickup tubes 87 and 89 of the present invention. It will be noted, particularly from FIG. 7, that unlike the extended pickup tubes 25 and 55 of the embodiments of FIGS. 1 through 5, the tubes 87, 89 surround the respective nozzles 69 and 71 to form a pair of independent flow paths. Thus, a substantial portion of the drilling fluid entering the hole through the nozzle 69 is removed from the hole by the extended pickup tube 87 so that this portion of the flow is confined to approximately 30 percent of the area of the hole bottom, substantially increasing the effectiveness of this flow and the removal of chips.

The extended pickup tubes 87 and 89 are welded to the lands 79, 85, as shown in FIG. 6 at 91, and extend circumferentially beyond the lands 79 and 85 in both directions to provide a pair of orifices 93, 95, best shown in FIG. 7, which permit a return flow path between the extended pickup tubes 87, 89 and the annular space between the drill string (not shown) and the previously drilled hole.

Drilling fluid thus enters the hole through the nozzles 69 and 71 and ultimately leaves the hole through the orifices 93 and 95. These orifices may be made larger than those shown in FIG. 7 if desired by cutting away a portion of the surface of the main body 65 of the rock bit 63.

As the rock bit 63 is rotated in the hole, the nozzles 69, 71 and extended pickup tubes 87, 89 sweep the bottom of the hole preceding and following the passage of each of the cones 75, 77 so that each of the cones 75, 77 is protected to the extent possible from rolling over and regrinding chips dislodged by the other cone.

As is particularly apparent from FIG. 7, the lower extremity of the pickup tubes 87, 89 is belled outwardly to provide as large a footprint on the bottom of the hole as practical without interfering with the operation of the cones 75, 77. The flow produced by this arrangement is shown in FIG. 6 as a radially outward flow from the nozzles 69, 71 toward the walls of the extended pickup tubes 87, 89 at which point the flow is directed upwardly to exit through the orifices 93 and 95. Thus, as with the embodiment of FIGS. 1 through 5, a substantial horizontal flow is induced, although in this case the flow is not across the cutting cones 75, 77 but is substantially confined to the area of the pickup tubes 87, 89. The tubes 87, 89, to be effective, should extend further from the main body 65 than do the nozzles 69, 71 and are preferably positioned close to the bottom of the hole being drilled, typically as close as one-eighth the diameter of the rock bit 63. The nozzles 69 and 71 may also be placed closer to the bottom of the hole being drilled, if desired, although erosion of the nozzle surfaces occurs if they are placed too close to the hole bottom.

From the three embodiments that have been described it can be seen that the primary feature of the present invention is the introduction of fluid, using nozzles for generating powerful streams vertically within the hole, and the removal of fluid from locations very close to the bottom of the hole. This arrangement results in a powerful horizontal flow along the bottom of the hole being drilled between adjacent cone cutters to reduce the amount of recutting and regrinding of previously loosened chips and thus extend the life of the bit.

I claim:

1. A drilling bit comprising:

a hollow body having an upper end for attachment to a rotating drill string, said body including a cavity for receiving high pressure drilling fluid from the center of said drill string;

nozzle means mounted on said body and connected to said cavity to receive high pressure drilling fluid from said hollow body to form primarily vertical, downward streams of fluid adjacent one side of said hollow body;

at least one and not more than three cone shaped cutters mounted on said hollow body, said cutters circumferentially spaced around the lower end of said body; and a pickup conduit mounted on said body and extending from a location near the lowest extremity of said cone shaped cutters to a location adjacent the upper end of said body exterior of said body, said conduit permitting direct flow of fluid entering a drilled hole through said nozzle means to the annular space between said drill string and said drilled hole, said conduit including sidewall portions that prevent flow of said fluid through the side of said conduit but instead direct flow into the lower end of the conduit thereby enhancing horizontal flow of said drilling fluid near the bottom of said hole.

2. A drilling bit as defined in claim 1 wherein said pickup conduit has a substantially triangular cross-sectional area at said location near the lower extremity of said cone shaped cutters.

3. A drilling bit as defined in claim 1 wherein said pickup conduit includes a pair of walls extending in a V-shape section adjacent one wall of the drilled hole so that with the wall of the drilled hole a flow channel is formed by the V-shaped section.

4. A drilling bit as defined in claim 1 wherein said pickup conduit extends substantially parallel to said vertical downward streams of fluid.

5. A drilling bit as defined in claim 1 wherein said nozzle means comprises a pair of nozzles, each of said nozzles and said pickup conduit separated from one another by 120° around the circumference of said hollow body.

6. A drilling bit as defined in claim 1 additionally comprising:

a raised annular rib extending beyond the outer perimeter of said hollow body above said nozzle means and said cone shaped cutters for reducing the annular space between said hollow body and the walls of the hole being drilled and to thereby increase the amount of flow through said pickup conduit.

7. A drilling bit as defined in claim 1 wherein the end of said pickup conduit at said location near the lowest extremity of said cone shaped cutters is cut in a plane which is not perpendicular to the axis of said pickup conduit.

8. A drilling bit as defined in claim 1 wherein said pickup conduit conducts at least 10 percent of the fluid entering said drilled hole through said nozzle means.

9. A drilling bit as defined in claim 1 wherein said pickup conduit is closer to the lowest extremity of said cone shaped cutter than one quarter of the diameter of said hollow body.

10. A drilling bit as defined in claim 1 wherein said pickup conduit is mounted on the side of said hollow body opposite said nozzle means.

11. A drilling bit as defined in claim 1 wherein said pickup conduit surrounds said nozzle means.

12. A rock bit, comprising:

a main body including a first end threaded for attachment to a drill string and a second end including a support member;

a conical drilling member rotatably mounted on said support member, said drilling member extending between the center of a hole being drilled and the outside diameter of said hole to grind the entire radius of said hole;

a fluid injection nozzle mounted on said main body and connected to a source of high pressure drilling fluid to direct said fluid toward the bottom of said hole being drilled; and means withdrawing fluid from the bottom of said hole being drilled, said means including a fluid conduit extending from said main body a distance which is slightly less than the distance of maximum extension of said conical drilling member from said body, said conduit including side wall portions that prevent flow of said fluid through the side of said conduit, and that instead direct fluid into a lower open end of the conduit.

13. A rock bit as defined in claim 12 wherein said means withdrawing fluid from the bottom of said hole generates a substantial horizontal flow vector of said fluid along the bottom of said hole being drilled.

14. A rock bit as defined in claim 12 wherein said means withdrawing fluid from the bottom of said hole comprises a conduit having a substantially triangular cross section.

15. A rock bit as defined in claim 12 wherein said means withdrawing fluid from the bottom of said hole comprises a conduit one side of which is formed by said hole being drilled.

16. A rock bit as defined in claim 12 wherein said fluid conduit surrounds said fluid injection nozzle.

17. A rock bit as defined in claim 12 comprising three of said conical drilling members rotatably mounted on said support member and evenly spaced around the circumference of said main body.

18. A rock bit as defined in claim 17 comprising a pair of said fluid injection nozzles, each mounted near the circumference of said main body and positioned between a pair of adjacent conical drilling members.

19. A rock bit as defined in claim 12 wherein said means withdrawing fluid extends from said main body to a distance within one-quarter of the diameter of said main body of the maximum extension of said conical drilling member from said main body.

20. A rock bit as defined in claim 19 wherein said means withdrawing fluid extends from said main body to within one-eighth of the diameter of said main body from said maximum extension of said conical drilling member from said main body.

21. A rock bit as defined in claim 12 wherein said fluid injection nozzle directs said fluid toward the bottom of said hole being drilled in a direction substantially parallel to the aixs of said hole being drilled.

22. A rock bit as defined in claim 21 wherein said fluid conduit extends substantially parallel to the axis of said hole being drilled.

23. A rock bit as defined in claim 12 additionally comprising:

means surrounding said main body and increasing the diameter of said main body at a location above said conical drilling member to inhibit flow of drilling fluid in the annular passage between said main body and said hole being drilled.

24. A rock bit as defined in claim 23 wherein said means inhibiting flow comprises an annular rib extending outwardly from said main body.

25. A rock bit as defined in claim 12 comprising a second conical drilling member on said main body diametrically opposed to the first mentioned drilling member.

26. A rock bit as defined in claim 25 comprising a pair of said fluid injection nozzles, each at diametrically opposed positions on said main body and at positions displaced 90° around the axis of said main body from said drilling members.

27. A rock bit as defined in claim 26 wherein said fluid conduit surrounds one of said pair of nozzles.

28. A rock bit as defined in claim 27 wherein said fluid withdrawing means comprises a second fluid conduit surrounding the other of said pair of nozzles.

29. A rock bit, comprising:

a main body;

three conical drilling members rotatably mounted on said main body, each of said members substantially filling a 120° circular segment on the bottom face of said main body;

a nozzle projecting below said main body toward said drilling members a first distance in a first direction for directing a flow of drilling fluid toward said drilling members; and a conduit for withdrawing said drilling fluid away from said drilling members, said conduit projecting below said main body toward said drilling members a second distance greater than said first distance, said conduit including side wall portions extending to an open lower end of the conduit to permit entry of said fluid to the conduit only through said lower end.

30. A rock bit as defined in claim 29 wherein said conduit projects below said main body in a direction substantially parallel to said first direction.

31. A rock bit as defined in claim 29 wherein one wall of said conduit is formed by the circular wall of a hole being drilled by said rock bit.

32. A rock bit as defined in claim 29 wherein said conduit projects to a location within one-eighth the diameter of said main body of the outermost extremity of said three conical drilling members.

33. A rock bit, comprising:

a main body;

a drilling member rotatably mounted on said main body and extending from the bottom of said main body;

a nozzle for directing a substantially vertical downward stream of drilling fluid from the bottom of said main body; and a pickup conduit extending from the bottom of said main body to carry away fluid injected by said nozzle, said conduit surrounding said downward stream of drilling fluid and including closed side walls that substantially prevent entry to the conduit except through its open lower end.

* * * * *